United States Patent [19]

Johnson et al.

[11] Patent Number: 5,004,007

[45] Date of Patent: Apr. 2, 1991

[54] CHEMICAL INJECTION VALVE

[75] Inventors: Dale V. Johnson, Metairie; John R. Gordon, New Orleans, both of La.

[73] Assignee: Exxon Production Research Company, Houston, Tex.

[21] Appl. No.: 330,680

[22] Filed: Mar. 30, 1989

[51] Int. Cl.[5] ..... G05D 7/01

[52] U.S. Cl. ..... 137/501; 137/155; 166/117.5; 166/321

[58] Field of Search ..... 137/501, 504, 494, 155; 166/117.5, 321, 324

[56] References Cited

U.S. PATENT DOCUMENTS

| | | | |
|---|---|---|---|
| 2,921,601 | 1/1960 | Fisher | 137/504 X |
| 3,993,129 | 11/1976 | Watkins | 137/155 X |
| 4,042,033 | 8/1977 | Holland et al. | 166/310 |
| 4,215,748 | 8/1980 | Pace et al. | 166/323 X |
| 4,216,830 | 8/1980 | Fredd | 137/504 |
| 4,407,329 | 10/1983 | Huebsch et al. | 137/629 |
| 4,407,363 | 10/1983 | Akkerman | 166/183 |
| 4,427,071 | 1/1984 | Carmody | 166/332 |
| 4,449,587 | 5/1984 | Rodenberger et al. | 166/323 |
| 4,452,310 | 6/1984 | Pringle et al. | 166/319 |
| 4,457,376 | 7/1984 | Carmody et al. | 251/298 |
| 4,503,913 | 3/1985 | Carmody | 166/319 |
| 4,527,630 | 7/1985 | Pringle | 166/321 |
| 4,562,854 | 1/1986 | Pringle et al. | 137/155 |
| 4,565,215 | 1/1986 | Cummings | 137/538 |
| 4,565,216 | 1/1986 | Giebeler | 137/494 |
| 4,601,342 | 7/1986 | Pringle | 166/323 |

OTHER PUBLICATIONS

Jerry Rubli, "New Developments in Subsurface Safety Valve Technology", Petroleum Engineer International, May 1980, pp. 96–110.

*Primary Examiner*—Stephen M. Hepperle

[57] ABSTRACT

An improved surface controlled chemical injection valve and method for injecting chemical fluid into the bore of a tubing string of a well are provided, the chemical injection valve having at least one piston movable in response to the pressure of the chemical fluid, an actuator connected to the piston, and a flow restrictor wherein the pressure of the chemical fluid supplied to the valve from the chemical fluid source acts on the piston to cause the actuator to open the valve and inject the chemical fluid into the tubing string bore. The flow restrictor is mounted downstream of the piston to create sufficient available pressure in the chemical fluid upstream of the flow restrictor to act on the piston and hold the valve in the open position.

9 Claims, 3 Drawing Sheets

FIG. 1 (PRIOR ART)
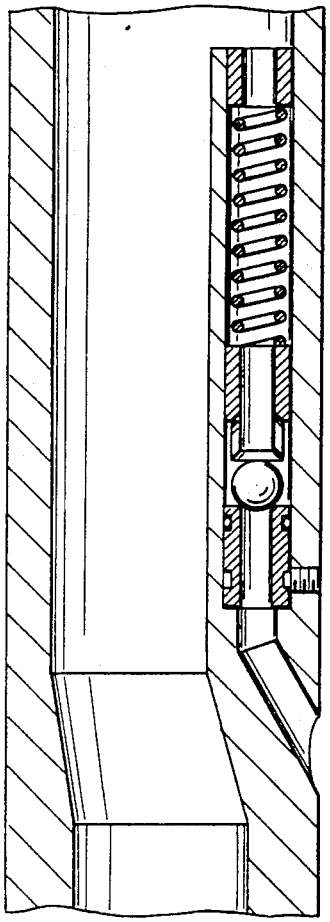
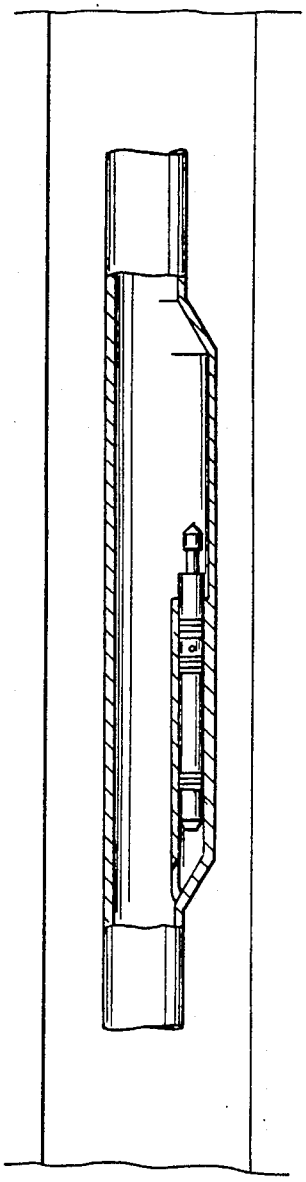
FIG. 2
FIG. 7
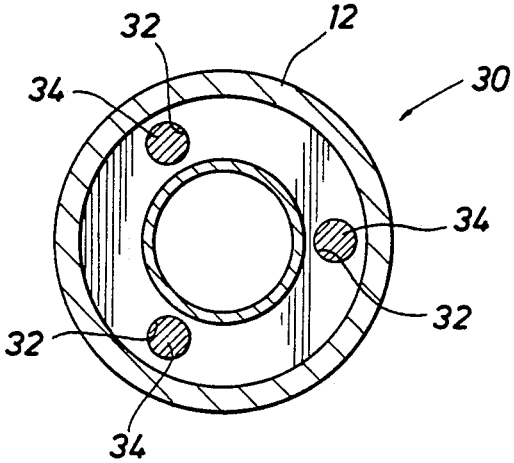

CHEMICAL INJECTION VALVE

FIELD OF THE INVENTION

This invention relates to an improved chemical injection valve and an improved method for injecting chemical fluid into the bore of a tubing string of a well. In particular, the invention pertains to a method and apparatus for opening and holding open a chemical injection valve by providing a flow restrictor downstream of a piston for activating the valve.

BACKGROUND OF THE INVENTION

Chemical injection valves are used to inject chemical fluids such as corrosion inhibitors, solvents, and other chemicals into the produced fluid in the bore of a tubing string of a well. The chemical fluids inhibit and alleviate corrosion of the tubing string and crystallization and subsequent deposition of paraffins, sulfates, and the like from the production fluid. Commercially available chemical injection valves, such as that shown in FIG. 1, typically use a spring operated ball-and-seat type of valve closure arrangement. In such a valve, chemical fluid is supplied to the valve from a surface source, and once inside the valve, the pressure of the chemical fluid urges the valve ball away from the seat. However, a spring exerts an opposing force on a valve follower which urges the valve ball to the seat. Therefore, to open the valve, the pressure of the chemical fluid must be greater than the opposing spring force plus the pressure in the tubing string bore. And to close the valve, the pressure of the chemical fluid must be less than the opposing spring force.

The problem with this type of chemical injection valve is that the valve ball and seat are constantly in the flow path of the chemical fluid and are therefore subject to the corresponding negative effects of the flow such as scale build up, deposits, and flow cutting. As a result of these negative effects, the valve ball may not seal tightly against the seat, and if the pressure in the bore of the tubing string is less than the pressure in the supply conduit, injection of chemical fluid into the tubing string bore will continue until the pressure equalizes across the valve. In addition, a surge of pressure in the tubing string bore may force production fluid through the valve and into the supply conduit.

SUMMARY

Applicants provide an improved valve and method for injecting chemical fluid from a chemical fluid source into the bore of a tubing string of a well. The improved valve has a housing which includes a flow passage therein for communicating with the tubing string bore and an opening therethrough communicating with the flow passage and the chemical fluid source. The valve may be mounted in a mandrel in the tubing string bore at a pre-selected location downhole. A valve closure is connected to the housing and is movable from a closed position to an open position. Means for urging the valve closure to its closed position, such as a spring, are included. When in its closed position, the valve closure is adapted to block flow of produced fluid from the tubing string bore into the flow passage of the valve. When the valve closure is in its open position, the valve is open and chemical fluid may be injected into the tubing string bore. An actuator for opening the valve closure is located in the housing. The actuator is movable from a first position, in which the valve closure is closed, to a second position, in which the valve closure is open, thereby permitting chemical fluid to flow through the flow passage into the tubing string bore. A flow restrictor in the flow passage restricts flow of the chemical fluid through the flow passage and thereby creates a pressure differential across the flow restrictor. At least one piston movably mounted in the housing is connected to the actuator and is in communication with the chemical fluid source upstream of the flow restrictor. The piston is adapted to move the actuator from its first position to its second position, wherein the valve closure is open, in response to the pressure of the chemical fluid upstream of the flow restrictor.

Operation of the valve is as follows. When chemical fluid is supplied to the valve from the chemical fluid source, the pressure of the chemical fluid acts on the piston which causes the actuator to move the valve closure to its open position, to open the valve and inject chemical fluid into the tubing string bore. Without a flow restrictor, the pressure of the chemical fluid upstream of the flow restrictor will decrease when the valve is opened and the chemical fluid is injected into the tubing string bore. However, the flow restrictor creates a pressure differential across the flow restrictor which results in sufficient available pressure in the chemical fluid upstream of the flow restrictor to cause the piston to hold the valve open. When the valve closure is in its open position, the actuator is designed to shield the valve closure from the chemical fluid, and as a result, to prevent erosion or damage to the valve closure so the valve closure will have a tighter and more reliable seal and the valve will have a tighter and more reliable shutoff.

BRIEF DESCRIPTION OF THE DRAWINGS

FIG. 1 is an illustration of a conventional chemical injection valve having a spring operated ball-and-seat type of valve closure arrangement.

FIG. 2 is an illustration of a chemical injection valve which is mounted in a side pocket mandrel in the tubing string of a well.

FIG. 7 is a cross sectional partial view of the chemical injection valve of the invention taken along line 7—7 of FIGS. 4 and 6.

DETAILED DESCRIPTION OF THE PREFERRED EMBODIMENTS

Figure 3:
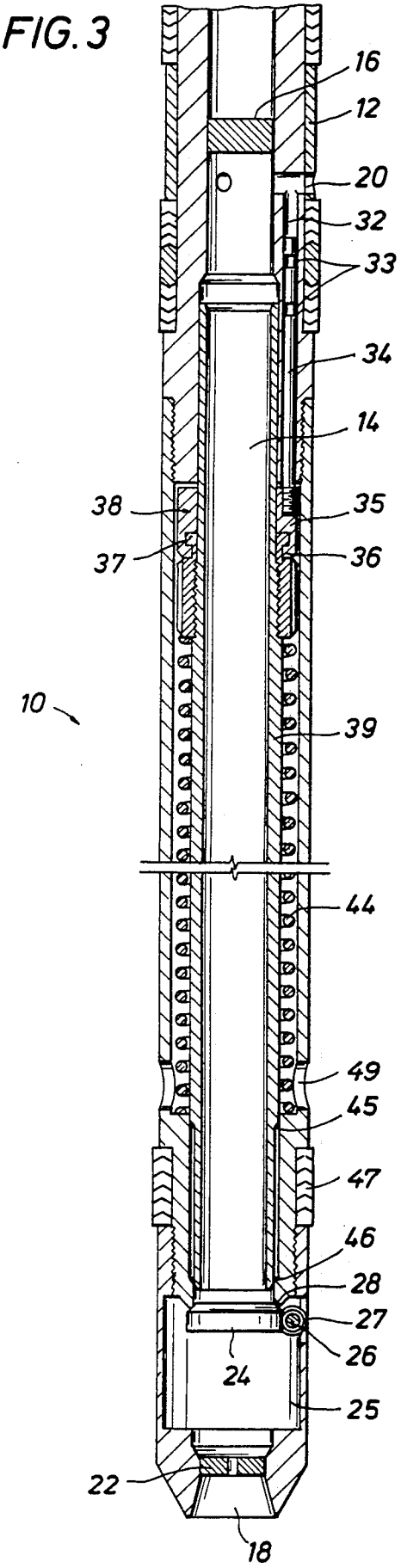
FIG. 3 is a cross sectional partial view of the chemical injection valve of the invention in which the valve is closed and the flow restrictor is located downstream of the valve closure.
Figure 4:
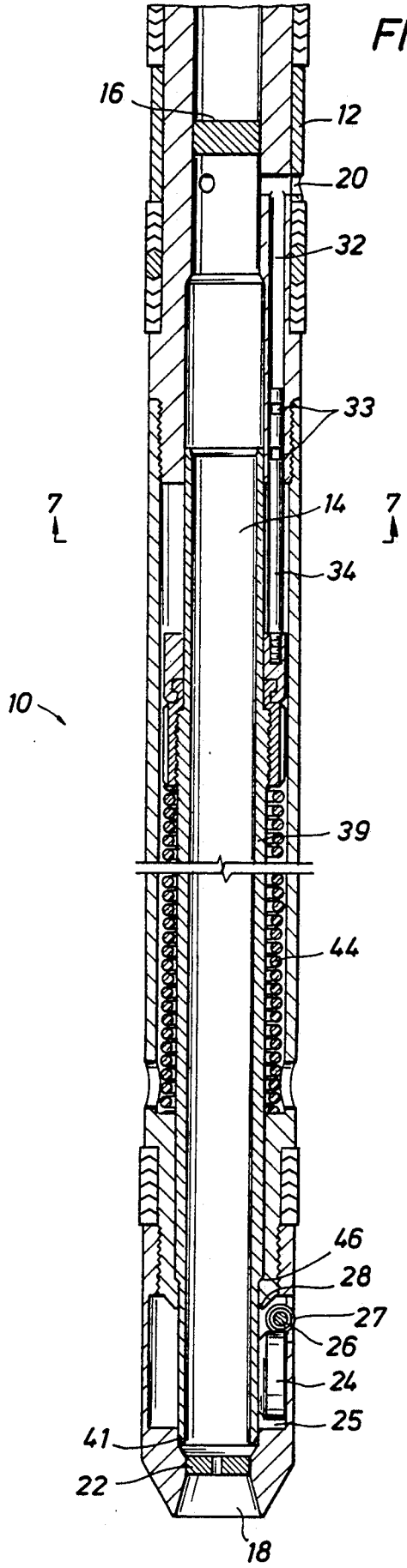
FIG. 4 is a cross sectional partial view of the chemical injection valve of the invention in which the valve is open and the flow restrictor is located downstream of the valve closure.

Referring to FIGS. 3 and 4, the reference numeral 10 generally indicates a preferred embodiment of the chemical injection valve of the present invention. The chemical injection valve 10 has a housing 12 including a flow passage 14 therein for defining the flow path of the chemical fluid and for communicating with the tubing string bore. The housing 12 is generally tubular and is adapted to be mounted to lock and set in a mandrel in the tubing string bore, as is shown in FIG. 2. It is not necessary to the invention that the housing be tubular. Any other suitable housings may be used. The flow passage 14 has a closed end 16, such as a threaded plug, for blocking flow of chemical fluid to the tubing string bore and an open end 18 communicating with the tubing string bore. The housing 12 also includes an opening 20 therethrough communicating with the flow passage 14 and the chemical fluid source which is located on the surface (not shown). Preferably, chemical fluid is introduced into the tubing-casing annulus for direct entry into the valve 10 through the opening in the housing 20. However, chemical fluid may be supplied to the valve 10 through a small diameter tubing (not shown) that passes from the chemical fluid source on the surface into the tubing-casing annulus and is connected to the injection mandrel and is in communication with the opening in the housing 20 in any suitable manner. Any other suitable means for supplying the chemical fluid to the opening in the housing 20 could be used. Referring to FIG. 3, packing 47 prevents production fluids from entering the opening 49 through the housing 12. As is known to those skilled in the art, a housing 12 which does not include the opening 49 could be used, and in that event packing 47 would not be needed.

A valve closure including a valve closure member 24 and a valve closure seat 28 is connected to the housing 12. The valve closure member 24 is pivotable from a closed position, in which it is seated against the valve closure seat 28 and the flow passage 14 is blocked from the flow of produced fluid from the tubing string bore into the flow passage 14, to an open position in which the valve is open. The valve closure member 24 is mounted on a pivot 26 and is biased to the closed position by a pivot spring 27. In this preferred embodiment, the valve closure member 24 is a flapper. However, the valve closure may be a rotating ball or a sliding seal, both of which are commercially available.

A generally tubular actuator 39 for opening the valve closure is coaxially mounted in the housing 12 and is movable from a first position, in which the valve closure member 24 is in its closed position, to a second position in which the valve closure member 24 is in its open position and, as shown in FIG. 4, the end 41 of the actuator 39 extends through the valve closure seat 28, so that the valve closure member 24 is positioned in the recess 25 of the housing 12. As a result, the actuator 39 is adapted to protect the valve closure member 24 and the valve closure seat 28 from the chemical fluid in the flow passage 14 because the valve closure member 24 and seat 28 are effectively isolated from the flow of chemical fluid in the flow passage 14. In this embodiment, the actuator 39 is adapted to protect the valve closure. However, any suitable shield located in the housing 12 which is adapted to move in response to the pressure of the chemical fluid upstream of the flow restrictor 22 may be used to protect the valve closure from the chemical fluid.

FIG. 7 shows piston unit 30 which is located in the housing 12. Piston unit 30 has at least one piston 34 which is adapted for movement within the piston bore 32. FIG. 7 shows a piston unit 30 which has three substantially identical pistons 34. Referring to FIGS. 3 and 4, one of the three pistons 34 is shown. The pistons 34 are connected to the actuator 39 and are adapted to move the actuator 39 from its first position to its second position, in which the valve 10 is open, in response to the pressure of the chemical fluid upstream of a flow restrictor 22 (which is described below). Each piston 34 is movably mounted in a piston bore 32 in the housing 12 that communicates with the opening in the housing 20 for fluid communication with the chemical fluid source. Seals 33, which may be o-rings, packing, metal to metal seals or any other suitable material, reduce or prevent leakage around the pistons 34. Each piston 34 is movable generally coaxially with the flow passage 14 and is adapted for longitudinal movement in each piston bore 32 in response to the pressure of the chemical fluid upstream of the flow restrictor 22. The end of each piston 34 may be threaded to receive a lug 35 with a lip 36 for engaging an annular groove 37 in a collar 38 that is connected to the actuator 39. A spring 44 urges the collar 38 upward to move the actuator 39 to its first position, wherein the valve is closed. The actuator 39 and the pistons 34 could be biased upward using compressed gas in place of the spring 44, as is well known to those skilled in the art. Compressed nitrogen is often used for such a purpose. Furthermore, one annular piston (not shown) around the actuator 39 could be used in place of pistons 34. However, pistons 34 are preferred when using the chemical injection valve in deep wells. The column of fluid acting on the surface area of a piston is greater in deep wells than in shallow wells. Because such an annular piston has a larger surface area than the combined surface areas of pistons 34, the downward force acting on an annular piston is greater than that acting on pistons 34. And as a result, a disproportionately large spring 44 could be required to urge the annular piston and thus the actuator to their positions wherein the valve is closed. In more shallow wells, the effect of the large surface area of an annular piston can be practically compensated for by a spring 44.

A flow restrictor 22 is located in the housing 12. The flow restrictor 22 restricts flow of the chemical fluid through the flow passage 14 and thereby creates a pressure differential across the flow restrictor 22. This pressure differential results in a greater pressure in the flow passage 14 than would exist without the flow restrictor 22. The flow restrictor 22 of the preferred embodiment is an orifice plate having an opening therethrough which is sized to restrict flow of the chemical fluid through the flow passage 14 and is connected to the housing 12 downstream of the valve closure member 24. The opening through the orifice plate 22 should be no smaller than approximately 0.125 inches, otherwise solids may clog the valve. The preferred material for the orifice plate 22 is Tungsten Carbide which is resistant to wear and erosion. However, other materials which are resistant to wear and corrosion may be used.

The orifice plate may be connected to the housing 12 or the actuator 39 in the flow passage 14 at any point between the opening through the housing 20 and the open end 18 of the flow passage 14, and the orifice plate will perform the same functions as described herein. However, the embodiment where the orifice plate 22 is connected to the housing 12 downstream of the valve closure member 24 is preferred because, in that location, the orifice plate will be relatively easy to remove without disassembling the valve 10.

Referring to FIG. 3, to initiate injection of chemical fluid into the tubing string bore, the pressure of the chemical fluid source is increased a predetermined amount such that the pressure of the chemical fluid upstream of the flow restrictor 22 acting on the pistons 34 will overcome the opposing force exerted by the spring 44, and as a result, the pistons 34 will move downward in the piston bores 32. As the pistons 34 move downward, the actuator 39 will also be moved downward by the collar 38 connected to the ends of the pistons 34 by lugs 35. As the actuator 39 moves downward, it pivots the valve closure member 24 from its closed position to its open position. The actuator 39 is prevented from further downward movement when the downwardly facing annular lip 45 on the actuator 39 contacts an upwardly facing actuator seat 46. The valve is thereby opened, permitting communication between the flow passage 14 and the tubing string bore, and the actuator 39 is in a position wherein it will protect the valve closure from the chemical fluid in the tubing string bore.

If the valve 10 does not have a flow restrictor 22, the pressure of the chemical fluid will decrease below its initial value when the valve 10 is opened and the chemical fluid is injected into the tubing string bore. The flow restrictor 22 is sized to restrict the flow of the continued supply of chemical fluid through the flow passage 14 in order to create a pressure differential across the flow restrictor 22. This pressure differential results in sufficient available pressure in the chemical fluid upstream of the flow restrictor 22 to act on the pistons 34 and hold the actuator 39 in its second position, in which the valve is open, thereby continuing injection of the chemical fluid into the tubing string bore.

To close the chemical injection valve 10, the supply of pressurized chemical fluid to the opening in the housing 20, and thus flow passage 14, is decreased such that the force exerted on the pistons 34 by the spring bias 44 is greater than the pressure of the chemical fluid upstream of the flow restrictor 22 which is acting on the pistons 34. When this occurs, the spring 44 urges the collar 38, and therefore the actuator 39 and the pistons 34, upward in the piston bores 32. As actuator 39 moves upward, valve closure member 24, which is biased to its closed position by pivot spring 27, will move to its closed position against valve closure seat 28, as shown in FIG. 3, and block flow of produced fluid from the tubing string bore into the flow passage 14 and thus into the chemical fluid source.

Figure 5:
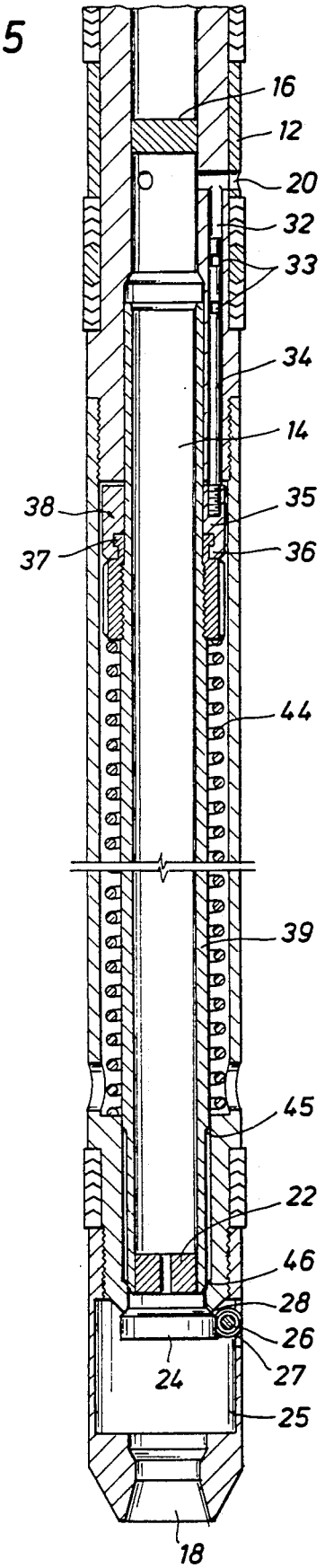
FIG. 5 is a cross sectional partial view of the chemical injection valve of the invention in which the valve is closed and the flow restrictor is connected to the actuator.
Figure 6:
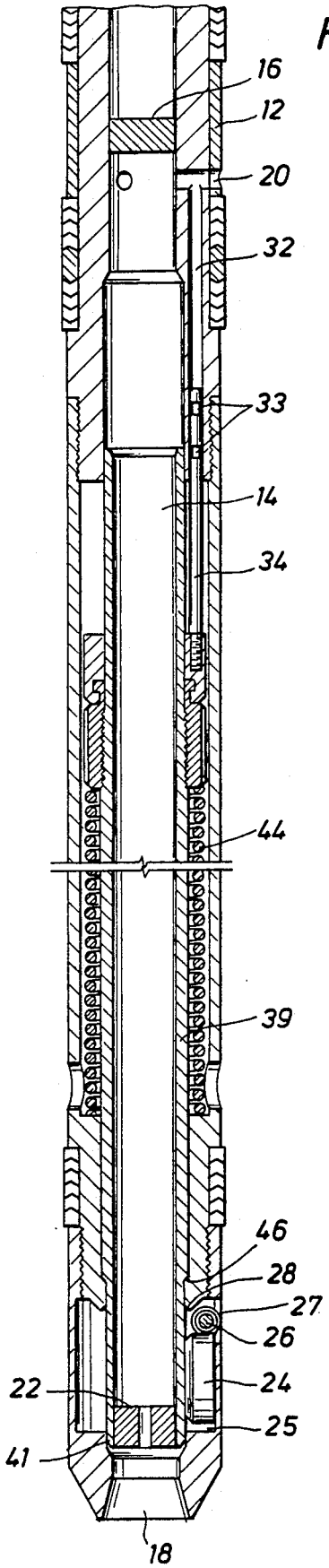
FIG. 6 is a cross sectional partial view of the chemical injection valve of the invention in which the valve is open and the flow restrictor is connected to the actuator.

FIGS. 5 and 6 show another embodiment of the present invention. This chemical injection valve 10 has the same parts and is opened in the same manner as the previously described embodiment. However, the actuator 39 is connected to the flow restrictor 22 in addition to the pistons 34, and the flow restrictor 22 is adapted to hold the actuator 39 in its second position in response to the pressure of the chemical fluid upstream of the flow restrictor 22. As with the previous embodiment, if the valve 10 does not have a flow restrictor 22, the pressure of the chemical fluid decreases below its initial valve when the valve 10 has been opened. Again, the flow of chemical fluid through the flow passage 14 is restricted by the flow restrictor 22, and a pressure differential across the flow restrictor 22 results. However, in this embodiment, this pressure differential results in sufficient available pressure in the chemical fluid upstream of the flow restrictor 22 to act, not only on the pistons 34 as described in the previous embodiment, but also on the flow restrictor 22 to hold the actuator 39 in its second position and the valve 10 in the open position.

As described above, the pistons 34 and the flow restrictor 22 are all attached to the actuator 39. It should be noted that a chemical injection valve (not shown) having a flow restrictor connected to an actuator, but not to a piston, could be opened and maintained in an open position by the pressure of the chemical fluid acting solely on the flow restrictor. However, as the flow rate of the chemical fluid fluctuates, the valve closure member may not remain fully open, but may fluctuate between an open and a closed position because the pressure of the chemical fluid acting on the flow restrictor alone may not create a great enough force to hold the valve closure member in a fully open position. If, as described in the above preferred embodiment, the pistons 34 and the flow restrictor 22 are all attached to the actuator 39, the pressure of the chemical fluid acting on the pistons 34 and the flow restrictor 22 creates a large enough force to decrease this fluctuation. As a result, there will be less wear on the valve 10 which will extend the service life of the valve 10.

Referring to FIGS. 5 and 6, to close the chemical injection valve 10, the supply of pressurized chemical fluid to the opening in the housing 20, and thus flow passage 14, is decreased such that the force exerted on the pistons 34 by the spring 44 is greater than the pressure of the chemical fluid upstream of the flow restrictor 22 which is acting on the pistons 34 and on the flow restrictor 22. When this occurs, the spring 44 will urge the pistons 34, and therefore the actuator 39 and the flow restrictor 22, upward in the piston bores 32. As the actuator 39 moves upward, the valve closure member 24, which is biased to its closed position by the pivot spring 27, will move to its closed position against the valve closure seat 28, as shown in FIG. 5. In this closed position, the valve closure member 24 blocks flow of produced fluid from the tubing string bore into the flow passage 14 and thus into the chemical fluid source.

Having described specific embodiments of the present invention, it will be understood that certain modifications thereof may be suggested to those skilled in the art and it is intended to cover all such modifications as fall within the scope of the Applicants' claims.

What we claim is:

1. A valve for injecting chemical fluid from a chemical fluid source into the bore of a tubing string of a well, the valve comprising:

a housing including a flow passage therein for communicating with the tubing string bore and an opening therethrough communicating with the flow passage and the chemical fluid source;

a valve closure including a flapper seat connected to the housing and a flapper pivotally connected to the housing, wherein the flapper is movable from a closed position to an open position wherein the valve is open;

an actuator in the housing for opening the valve closure and movable from a first position, wherein the valve closure is closed; to a second position wherein the valve closure is open;

a flow restrictor in the flow passage, connected to the housing, for creating a pressure differential across the flow restrictor; and at least one piston connected to the actuator, in communication with the fluid source upstream of the flow restrictor, and adapted to move the actuator from its first position to its second position in response to the pressure of the chemical fluid upstream of the flow restrictor; whereby the pressure differential across the flow restrictor results in sufficient available pressure in the chemical fluid upstream of the flow restrictor to cause the piston to hold the valve open.

2. The injection valve of claim 1 further comprising: a shield in the housing adapted to move in response to the pressure of the chemical fluid upstream of the flow restrictor to a position wherein it protects the valve closure from the chemical fluid.

3. A valve as defined in claim 1 wherein the flow restrictor is connected to the housing downstream of the valve closure.

4. A valve as defined in claim 2 wherein the actuator and the shield are integral and adapted to move the valve closure to its open position in response to the pressure of the chemical fluid upstream of the flow restrictor and adapted to shield the valve closure from the fluid.

5. A valve for injecting chemical fluid from a chemical fluid source into the bore of a tubing string of a well, the valve comprising:

a housing including a flow passage therein for communicating with the tubing string bore and an opening therethrough communicating with the flow passage and the chemical fluid source;

a valve closure including a flapper seat connected to the housing and a flapper pivotally connected to the housing wherein the flapper is movable from a closed position, wherein the flapper is adapted to block flow from the tubing string bore, to an open position wherein the valve is open;

an actuator movable in the housing for opening the valve closure and movable from a first position, wherein the flapper is in its closed position, to a second position, wherein the flapper is in its open position and adapted to protect the flapper and the flapper seat from the chemical fluid in the flow passage;

a flow restrictor connected to the housing for creating a pressure differential across the flow restrictor; and at least one piston in the housing, connected to the actuator, in communication with the chemical fluid source upstream of the flow restrictor, and adapted to move the actuator from its first position to its second position in response to the pressure of the chemical fluid upstream of the flow restrictor; whereby the pressure differential across the flow restrictor results in sufficient available pressure in the chemical fluid upstream of the flow restrictor to cause the piston to hold the valve open.

6. A valve as defined in claim 5 wherein the flow restrictor is connected to the housing downstream of the valve closure.

7. A valve as defined in claim 5 wherein the flow restrictor is an orifice plate having an opening therethrough sized to restrict flow of the chemical fluid through the flow passage for creating a pressure differential across the orifice plate.

8. A chemical injection valve for injecting chemical fluid from a chemical fluid source into the bore of a tubing string of a well, the chemical injection valve comprising:

a tubular housing adapted to be mounted to a mandrel in the tubing string, the housing including a flow passage therein having a closed end and an open end communicating with the tubing string bore, an opening therethrough communicating with the flow passage and the chemical fluid source, and at least one piston bore therein generally coaxial with the housing;

a valve closure including a flapper seat connected to the housing and a flapper pivotally connected to the housing wherein the flapper is movable from a closed position, in which it is seated against the flapper seat and the flow passage is blocked from flow of produced fluid from the tubing string bore into the flow passage, to an open position wherein the valve is open;

an actuator tube generally coaxial with the flow passage for opening the valve closure and longitudinally movable from a first position, wherein the flapper is in its closed position, to a second position, wherein the flapper is in its open position, and adapted to shield the flapper and the flapper seat from the chemical fluid in the flow passage;

an orifice plate, connected to the housing in the flow passage between the opening through the housing and the open end of the flow passage, the orifice plate having an opening therethrough sized to restrict flow of the chemical fluid through the flow passage for creating a pressure differential across the flow restrictor; and at least one piston in the housing generally coaxial with the flow passage and adapted for longitudinal movement in the piston bore, and connected to the actuator tube, the piston in communication with the opening in the housing for fluid communication with the chemical fluid source upstream of the orifice plate and adapted to move the actuator tube from its first position to its second position in response to the pressure of the chemical fluid upstream of the orifice plate; whereby the pressure differential across the orifice plate results in sufficient available pressure in the chemical fluid upstream of the orifice plate to act on the piston and thereby hold the valve open.

9. A chemical injection valve as defined in claim 8 further comprising a spring for biasing the actuator tube to its first position wherein the flapper is in its closed position.

* * * * *